US006263958B1

(12) United States Patent
Fleishman

(10) Patent No.: US 6,263,958 B1
(45) **Date of Patent: *Jul. 24, 2001**

(54) HEAT EXCHANGERS THAT CONTAIN AND UTILIZE FLUIDIZED SMALL SOLID PARTICLES

(76) Inventor: William H. Fleishman, 836 Rio Dr., Friendsville, TN (US) 37737

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 6 days.

(21) Appl. No.: 09/028,053

(22) Filed: Feb. 23, 1998

(51) Int. Cl.[7] ..... F28D 13/00
(52) U.S. Cl. ..... 165/104.16; 165/104.15; 122/4 D; 422/146; 422/147
(58) Field of Search ..... 165/104.15, 104.16; 422/146, 147; 122/4 D

(56) References Cited

U.S. PATENT DOCUMENTS

| | | | | |
|---|---|---|---|---|
| 2,934,551 | * | 4/1960 | Stringer | 165/104.16 |
| 3,053,704 | * | 11/1962 | Munday | 165/104.16 |
| 3,645,237 | * | 2/1972 | Seth | 165/104.16 |
| 3,645,700 | | 2/1972 | Nagamura et al. . | |
| 3,666,006 | | 5/1972 | Valyi . | |
| 3,794,110 | | 2/1974 | Severijins . | |
| 3,814,176 | * | 6/1974 | Seth | 165/104.16 |
| 3,864,282 | | 2/1975 | Young . | |
| 3,897,546 | | 7/1975 | Beranek et al. . | |
| 3,902,550 | | 9/1975 | Martin et al. . | |
| 3,930,800 | * | 1/1976 | Schoener et al. | 165/104.16 |
| 3,990,862 | | 11/1976 | Dahl et al. . | |
| 4,025,462 | | 5/1977 | Cleveland . | |
| 4,096,214 | | 6/1978 | Percevaut et al. . | |
| 4,111,675 | | 9/1978 | Ballard . | |
| 4,119,139 | | 10/1978 | Klaren . | |
| 4,149,586 | * | 4/1979 | Phillips et al. | 165/104.16 |
| 4,335,785 | * | 6/1982 | Hodges et al. | 165/104.16 |
| 4,423,558 | | 1/1984 | Meunier . | |
| 4,450,895 | | 5/1984 | Meunier et al. . | |
| 4,472,358 | | 9/1984 | Khudenko . | |
| 4,478,276 | | 10/1984 | Rosenbaum et al. . | |
| 4,499,944 | * | 2/1985 | Komakine | 165/104.16 |
| 4,522,252 | | 6/1985 | Klaren . | |
| 4,526,759 | * | 7/1985 | Stewart | 165/104.16 |
| 4,561,385 | | 12/1985 | Cross et al. . | |
| 4,580,618 | | 4/1986 | Newby . | |
| 4,588,429 | | 5/1986 | Hohman et al. . | |
| 4,597,362 | * | 7/1986 | Daudet et al. | 165/104.16 |
| 4,674,560 | | 6/1987 | Marcellin . | |
| 4,719,968 | | 1/1988 | Speros . | |
| 4,796,691 | | 1/1989 | Large et al. . | |
| 4,823,739 | | 4/1989 | Marcellin . | |
| 4,862,954 | | 9/1989 | Hellio et al. . | |
| 4,955,942 | * | 9/1990 | Hemenway, Jr. | 165/104.16 |
| 4,971,141 | | 11/1990 | Kasahara et al. . | |
| 4,981,355 | | 1/1991 | Higgins . | |
| 5,000,255 | | 3/1991 | Pflum . | |
| 5,109,918 | | 5/1992 | Huschka et al. . | |

(List continued on next page.)

OTHER PUBLICATIONS

"Adapt Fluidized Bed Coal Firing to Process Heaters" D.C. Cherrington and L.P Golan in Hydrocarbon Processing May 1978.

*Primary Examiner*—Ira S. Lazarus
*Assistant Examiner*—Terrell McKinnon
(74) *Attorney, Agent, or Firm*—Robert E. Bushnell, Esq.

(57) ABSTRACT

Heat exchangers that utilize flat surfaced passages to contact, contain and utilize fluidized small solid particles. A variety of flat surfaced small solid particles with high heat transfer surfaces are provided to further enhance the heat transfer rate. Astonishingly high heat transfer coefficients have been reported for surfaces immersed in fluidized beds. More energy efficient systems of all kinds will result from the use of these smaller heat exchangers.

41 Claims, 2 Drawing Sheets

U.S. PATENT DOCUMENTS

| | | | |
|---|---|---|---|
| 5,143,708 | 9/1992 | Nakazawa et al. . | |
| 5,181,558 | 1/1993 | Tsuda et al. . | |
| 5,314,008 | 5/1994 | Carcia-Mallol . | |
| 5,320,168 | 6/1994 | Haight . | |
| 5,347,953 | 9/1994 | Adbulally . | |
| 5,356,462 | 10/1994 | Brüggendick . | |
| 5,380,497 * | 1/1995 | Ivanov et al. | 165/104.16 |
| 5,533,471 | 7/1996 | Hyppänen . | |
| 5,568,834 | 10/1996 | Korenberg . | |
| 5,601,039 | 2/1997 | Hyppänen . | |
| 5,634,516 | 6/1997 | MyÖhänen et al. . | |

* cited by examiner

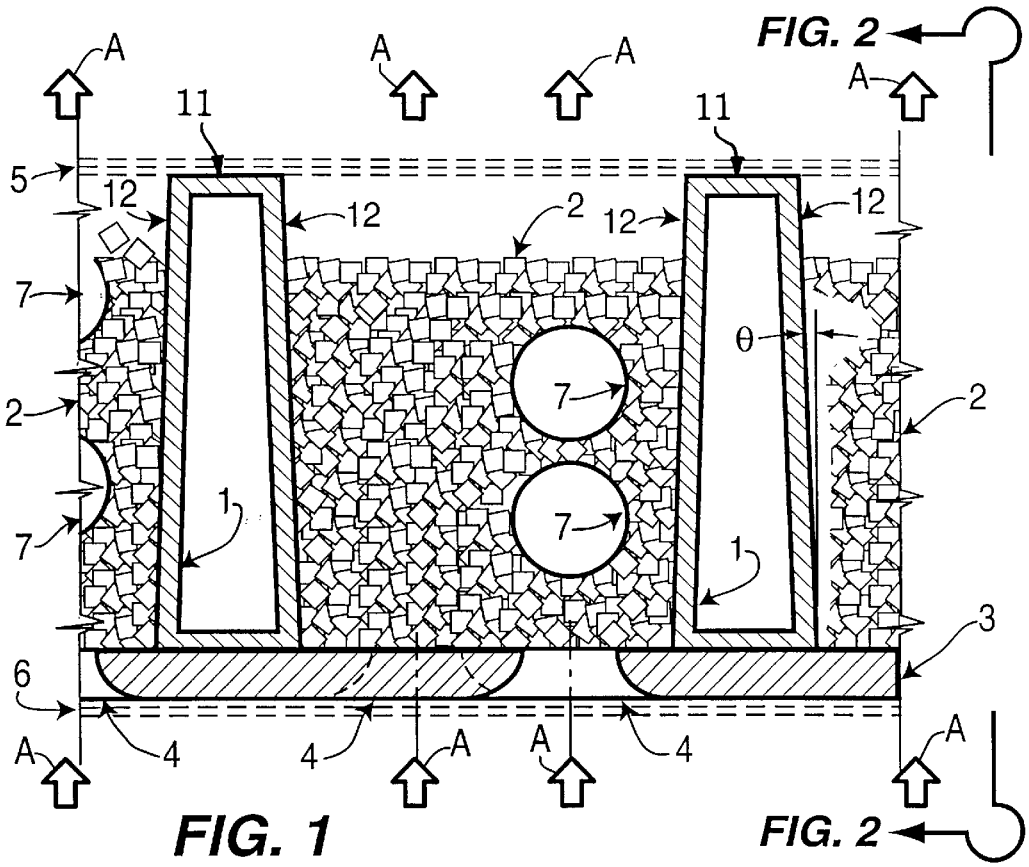
FIG. 2
A
11
5
12
2
7
θ
1
3
6
4
FIG. 1
FIG. 2
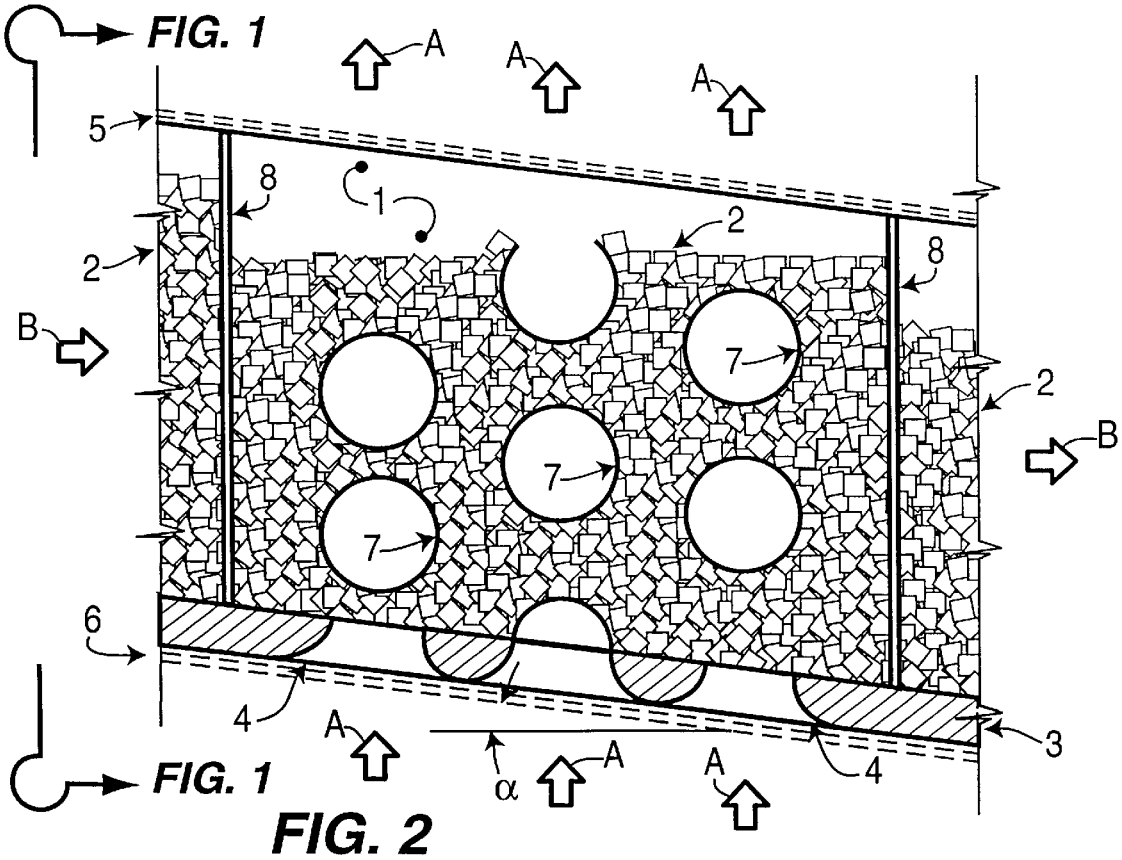
FIG. 1
A
5
8
1
2
B
7
6
4
3
α
FIG. 1
FIG. 2

HEAT EXCHANGERS THAT CONTAIN AND UTILIZE FLUIDIZED SMALL SOLID PARTICLES

BACKGROUND OF THE INVENTION

1. Field of the Invention

This invention relates to heat exchangers generally, and, more particularly, to heat exchange processes and to heat exchangers that contain and utilize fluidized small solid particles to improve the transfer of heat on one side of the wall that separates two fluids.

2. Background Art

A common method of exchanging heat between fluids is to position an enclosure of one of the fluids within an enclosure of a second fluid. Then, by directing the fluids through their respective enclosure, heat is transferred from the hotter fluid to the colder fluid. This type of device is commonly referred to as a heat exchanger. Where one of the fluids involved in a commercial heat exchanger is a gas, such as air, the overall transmission coefficient is in the range from 2 to 10 BTU/hr° F. $ft^2$ (i.e. British thermal unit per hour-degree Fahrenheit). With such a low heat transfer coefficient, commercially available heat exchangers are built with large areas, such as finned or wrinkled tubes, that also require large temperature differences to effectively transfer heat. The users of such heat exchangers are forced to generate large temperature differences, thus making the use of the heat exchanger less energy efficient.

Much higher heat transfer rates have been reported for surfaces immersed in small solid particles, such as sand particles, that are suspended and kept in motion by an upward flow of a fluid. The heat transfer coefficient for these type of heat exchangers can be as high on average as 225 to approximately 250 BTU/hr° F. $ft^2$. Some heat exchanger systems that immerse surfaces in small solid particles are shown, for example, in U.S. Pat. No. 5,634,516 to Myöh änen entitled Method and Apparatus for Treating or Utilizing a Hot Gas Flow, U.S. Pat. No. 5,568,834 to Korenberg entitled High Temperature Heat Exchanger, U.S. Pat. No. 5,533,471 to Hyppänen entitled Fluidized Bed Reactor and Method of Operation Therefor, and U.S. Pat. No. 4,580,618 to Newby entitled Method and Apparatus for Cooling a High Temperature Waste Gas Using a Radiant Heat Transfer Fluidized Bed Technique.

Most heat exchangers that have heat transfer coefficients in the range from 35 to 50 BTU/hr° F. $ft^2$ use conventional round tubes or pipes. As opposed to the flat surfaces often used to obtain higher rates of heat transfer. Small solid particles make only line or point contact with rounded surfaces. Thus, the amount of heat conducted from or to the small solid particles in contact with rounded surfaces is limited to a small area of contact. It is natural that the studies that used rounded surfaces reported the lower rates and that the studies that used flat surfaces reported that higher rates.

Some heat exchangers allow the fluidized small solid particles to flow into or out of the heat exchanger, as shown, for example, in U.S. Pat. No. 5,347,953 to Adbulally entitled Fluidized Bed Combustion Method Utilizing Fine and Coarse Sorbent Feed, U.S. Pat. No. 5,320,168 to Haight entitled Heat Exchange System for Processing Solid Particulates, U.S. Pat. No. 5,314,008 to Garcia-Mallol entitled Fluid-Cooled Jacket for an Air-Swept Distributor, U.S. Pat. No. 4,862,954 to Hellio entitled Exchanger and Method for Achieving Heat Transfer From Solid Particles, U.S. Pat. No. 4,823,739 to Marcellin entitled Apparatus for Control of the Heat Transfer Produced in a Fluidized Bed, U.S. Pat. No. 4,796,691 to Large entitled Fluidized Bed Heat Exchange Apparatus, U.S. Pat. No. 4,674,560 to Marcellin entitled Process and Apparatus for Control of the Heat Transfer Produced in a Fluidized Bed, U.S. Pat. No. 4,580,618 to Newby entitled Method and Apparatus for Cooling a High Temperature Waste Gas Using a Radiant Heat Transfer Fluidized Bed Technique, U.S. Pat. No. 4,561,385 to Cross entitled Fluidized Bed Shell Boilers and U.S. Pat. No. 4,450,895 to Meunier entitled Process and Apparatus for Heating or Cooling Light Solid Particles.

Some heat exchangers use the downward flow of particles caused by gravity to circulate the small solid particles, as shown, for example, in U.S. Pat. No. 5,601,039 to Hyppänen entitled Method and Apparatus for Providing a Gas Seal in a Return Duct and/or Controlling the Circulating Mass Flow in a Circulating Fluidized Bed Reactor, U.S. Pat. No. 5,000,255 to Pflum entitled Fluidized Bed Heat Exchanger, and U.S. Pat. No. 4,522,252 to Klaren entitled Method of Operating a Liquid—Liquid Heat Exchange.

Many different types of heat exchangers have been developed over the years. U.S. Pat. No. 5,181,558 to Tsuda entitled Heat Exchanger mentions employing a coating film on heat exchanger fins to cause water droplets to more easily roll down the fin rather than bead. Both U.S. Pat. No. 5,109,918 to Huschka entitled Device for the Thermal Treatment of Organic and Inorganic Substances and U.S. Pat. No. 4,423,558 to Meunier entitled Device for Heat Exchange Between Solid Particles and a Gas Current show using burners to heat the small solid particles. U.S. Pat. No. 5,000,255 to Pflum entitled Fluidized Bed Heat Exchanger shows creating a circulating pattern by making the distance between the distributor plate and the tube inlets greater than or equal to five times the diameter of the particles. U.S. Pat. No. 4,971,141 to Kasahara entitled Jet Stream Injection System mentions using slits or slots below round heat exchanger tubes to inject the fluidizing fluid. U.S. Pat. No. 5,143,708 to Nakazawa entitled Tetracosahedral Siliceous Particles and Process for Preparation Thereof shows using a primary particle size of 0.1 to 50 $\mu$m. U.S. Pat. No. 4,719,968 to Speros entitled Heat Exchanger mentions a fluidized bed that has small solid particles that are packed together and only allows the fluid through the particle pack via interstitial passageways. U.S. Pat. No. 4,472,358 to Khudenko entitled Packing for Fluidized Bed Reactors shows using various devices to suppress a bubbling particle bed. U.S. Pat. No. 4,561,385 to Cross entitled Fluidized Bed Shell Boilers mentions burning fuel in the particle bed material. U.S. Pat. No. 4,119,139 to Klaren entitled Heat-Exchanger Comprising a System of Granulate Containing Vehicle Tubes, and a Method For Operating the Same shows a heat exchanger that used vertical tubes to catch particles that are fed cyclically into the top and then fall down the tube while increasing in size. U.S. Pat. No. 4,096,214 to Percevaut entitled Multicellular Reactor With Liquid/Gas Phase Contacts mentions a heat exchanger that brings a fluid in contact with a gas during the heat exchange process. U.S. Pat. No. 3,902,550 to Martin entitled Heat Exchange Apparatus shows a heat exchange apparatus that has heating elements or coils in a fluidized bed. U.S. Pat. No. 3,897,546 to Beranek entitled Method of Cooling or Heating Fluidized Beds shows the combustion of fuels using two fluidized particle beds. U.S. Pat. No. 3,814,176 to Seth entitled Fixed-Fluidized Bed Dry Cooling Tower mentions using larger particles embedded within a bed of smaller particles.

SUMMARY OF THE INVENTION

I believe it may be possible to improve on the art of heat exchangers by providing a heat exchanger that contains the small solid particles in the fluidized bed inside the heat exchanger, that has heat transfer surfaces that are not immersed in the small solid particles, that has a loosely packed fluidized bed of small solid particles, that generally only allows a bubbling boiling movement of the small solid particles direction rather than allowing a circulating motion, that does not need to use devices to restrain the fluidized bed, does not require any special coating on the heat exchanger surface, that has no vertical tubes, that maintains the two fluids exchanging heat separate from each other, does not require using heating elements in the fluidized bed, that uses flat walls to increase the heat transfer coefficient, that does not use slits or slots, that does not have a space between the distributor plate and the bottom of the tube inlets that creates circulating fluid patterns, that does not require embedding larger particles in the fluidized bed, and uses small solid particles with shapes that allow for an increased amount of heat exchange. This should allow heat exchangers of all types to be made smaller than priorly possible while still maintaining the same level of heat transfer between the two fluids.

Accordingly, it is an object of the present invention to provide an improved heat exchanger using fluidized small solid particles.

It is another object to provide a heat exchanger with a heat transfer coefficient of 35 BTU/hr° F. $ft^2$ or higher.

It is still another object to provide a heat exchanger that is smaller and more energy efficient than any commercially available heat exchanger, especially compared to heat exchangers that use gas.

It is yet another object to provide a heat exchanger that uses flat surfaces.

These and other objects may be achieved with a heat exchanger uses a fluidized bed of small solid particles that are suspended in a flow of some fluid, i.e., the downward tendency of the small solid particles to fall by gravity is equaled by the upward drag force of the fluid flow. A bed of small solid particles is said to be fluidized when it takes on liquid-like properties, i.e., the surface is level, it will flow like a liquid, resembles a boiling liquid, and so forth.

The small solid particles contained and utilized by the heat exchanger must be selected or manufactured to maximize their effectiveness as heat transmitters. The small solid particles may be constructed of coarse solids rather than powders. When the small, solid-phase particles are fluidized by the proper upward flow of a fluid, the small solid particles pass fluid bubbles that causes the solid particles to resemble a vigorously boiling liquid. The bubbles cause the small solid particles to move quickly from the flat surfaces of the heat exchanger into the fluid and then back again.

The surfaces of the small solid particles should preferably be flat to more quickly pass heat to or from the flat surfaces of the heat exchanger. The residence time of contact between the flat surfaces will be short owing to the rapid boiling motion. The surfaces of the small solid particles should preferably have high heat conduction rates (like aluminum, copper, silver, and other solid phase materials and alloys that exhibit a relatively high coefficient of thermal conductivity.) and sufficient heat storage capacity to serve effectively. The materials used to construct the small solid particles will be selected so that the fluids that will be used with the particles will not corrode the small solid particles or be contaminated by them.

Woven wire mesh or perforated sheets on the top will be required to contain the small solid particles from falling out when the heat exchangers are handled. Woven wire mesh or perforated sheets may be required on the bottom to keep the small solid particles from draining out when the heat exchanger is not in service.

BRIEF DESCRIPTION OF THE DRAWINGS

A more complete appreciation of this invention, and many of the attendant advantages thereof will be readily apparent as the same becomes better understood by reference to the following detailed description when considered in conjunction with the accompanying drawings in which like reference symbols indicate the same or similar components, wherein:

FIG. 1 is a cross-sectional view of a heat exchanger as constructed according to the principles of the present invention at a right angle to the flat surfaced pipe or tubing that conveys one of the fluids horizontally;

FIG. 2 is a cross-sectional view of the heat exchanger of FIG. 1 that is taken at a right angle to the cross-sectional view of FIG. 1;

DETAILED DESCRIPTION OF THE PREFERRED EMBODIMENT

Figure 3A:
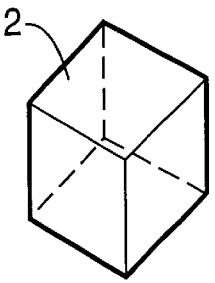
FIGS. 3*a* and 3*b*, 3*c* and 3*d* are three-dimensional views of small solid particles that can be manufactured for use in the heat exchanger of FIG. 1 and that have top and bottom surfaces at right angles to the side surfaces.

Turning now to the drawings, FIG. 1 is a cross-sectional view of the heat exchanger that is drawn at a right angle to flat surfaced pipe or tubing 1 that conveys one of the fluids involved horizontally through the heat exchanger. The direction of the second fluid that is conveyed through the heat exchanger is denoted by the arrows A. Small solid particles 2 are drawn as squares to represent cubes, which is one of the preferred solid shapes. Flattened pipe or tubing 1 is firmly attached to grid plate 3 that is perforated with orifices 4 that introduce the other fluid involved. Top 12 woven wire mesh or perforated sheet 5 is held tightly against top side 11 of flattened pipe or tubing 1 to keep small solid particles 2 from falling out when the heat exchanger is shipped or handled. Bottom woven wire mesh or perforated sheet 6, that may be optionally used, can be held tightly against the bottom or inlet side of grid plate 3 to keep small solid particles 2 from draining out whenever the heat exchanger has no upward flowing fluid, as indicated by the large dark arrows that point up, through the orifices. Bubbles 7 are formed above orifices 4 whenever more fluid is introduced through orifices 4 than will pass through the spaces between small solid particles 2. The 9 denoted angle θ represents the slope angle, relative to the vertical, of flat sides 12 of the flattened pipe or tubing 1.

FIG. 2 is a cross-sectional view of the heat exchanger of FIG. 1 taken at a right angle to FIG. 1. The bent arrows D bracketing one corner of the heat exchanger in FIG. 2 denote the same corner of the heat exchanger as that bracketed by bent arrows C in FIG. 1. The side of flattened pipe or tubing 1 that conveys the horizontally flowing fluid is shown as well as its fluid flow that is indicated by the large dark arrows B that point from left to right. The second fluid conveyed through the heat exchanger is denoted by the arrows A. The fluid flow causes bubbles 7 to form in the small solid particles. Small solid particles 2 are fluidized (i.e., a fluid formed by movement of a plurality of particles 2 made of solid phase materials while in a partial suspension) by liquid coming through orifices 4 in grid plate 3. Bottom woven wire mesh or perforated sheet 6 prevents the particles from draining out of the heat exchanger when the heat exchanger is not in use. Grid plate 3 is shown pitched at the angle $\alpha$ that may be required for drainage of the horizontally flowing fluid, especially for steam condensate when steam is the horizontally flowing fluid. The angle $\alpha$ is shown at an exaggerated angle to the horizontal to more easily show the need for pitch divider fins 8. The surface of small solid particles 2 are fluidized by the upward flowing fluid. Pitch divider fins 8 will keep small solid particles 2 from draining to the lower end of the heat exchanger. Pitch divider fins 8 may be used even when the heat exchanger is not pitched whenever their cost can be justified by increased heat transfer.

Figure 3B:
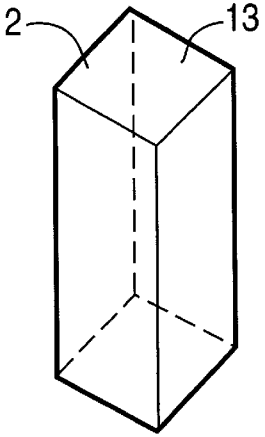
Figure 3C:
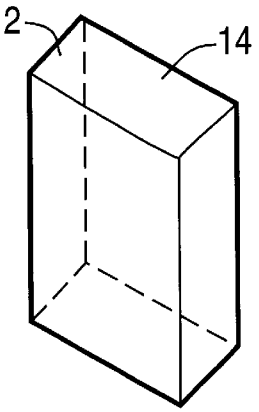
Figure 3D:
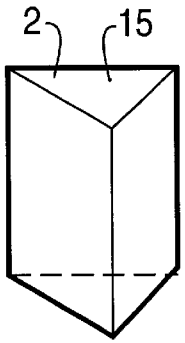

FIG. 3*a* shows cube shaped small particle 12. The cube shape may be the most commonly used three-dimensional shape for the small solid particles to be manufactured in. The added cost of creating the small cube-shaped particles can be justified by the increased heat transfer over that attained using naturally occurring, coarse solids, such as sand. FIG. 3*b* shows a regular prism shaped small particle with square ends 13 that are at right angles to the sides. FIG. 3*c* shows a regular prism shaped small particle with rectangular ends 14 that are at right angles to the sides. FIG. 3*d* shows a regular prism shaped small particle with triangular ends 15 that are at right angles to the sides. The advantage of using small particles that have flat surfaces is that it further increases the heat transferred when the particle is in contact with the heat transfer surface. By constructing a heat exchanger that only uses flat walls along heat exchanging surfaces and flat surfaced particles the amount of heat transferred by contact between the particle and the wall is increased. It is possible to combine various shaped particles in one heat exchanger. For example, a fluidized bed may have both regular prisms with triangular ends 15 and cubic shaped small particles 12, or any other combination of small particles.

Figure 4A:
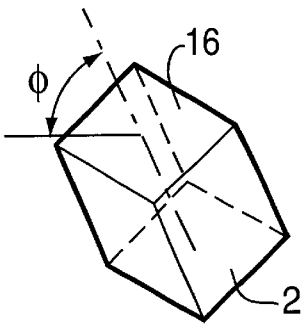
FIGS. 4*a*, 4*b*, 4*c* and 4*d* are three-dimensional views of small solid particles that can be manufactured for use in the heat exchanger of FIG. 1 and that have top and bottom surfaces that are at some angle Ø to the centerline that runs through the centroids of the top and bottom surfaces.
Figure 4B:
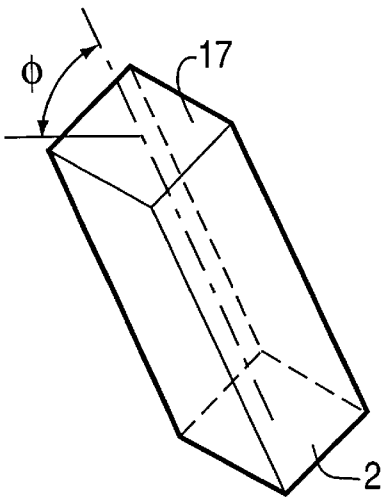
Figure 4C:
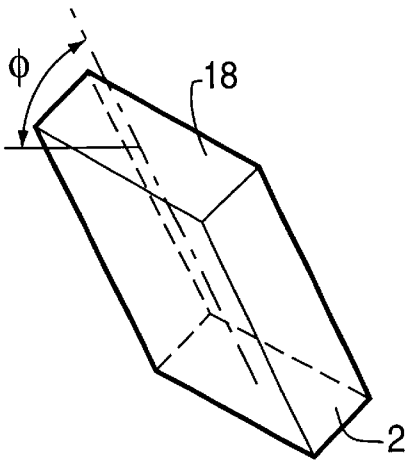
Figure 4D:
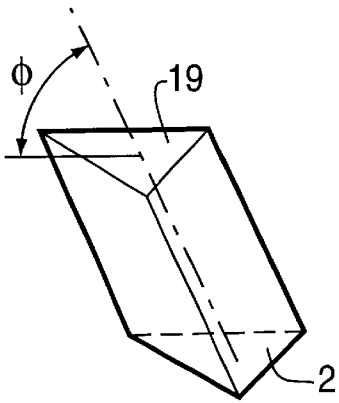

FIG. 4*a* shows a prism shaped small particle with square ends 16 that are at angle Ø to the lengthwise centerline that has the same volume as a cube. The angle Ø will be from 0 to 60°. FIG. 4*b* shows a prism shaped small particle with square ends 17 that are at angle Ø to the lengthwise centerline. FIG. 4*c* shows a prism with rectangular ends 18 that are at angle Ø to the lengthwise centerline. FIG. 4*d* shows a prism with triangular ends 19 that are at angle Ø to the lengthwise centerline.

FIGS. 3*a,* 3*b,* 3*c,* 3*d,* 4*a,* 4*b,* 4*c* and 4*d* are all possible shapes for the small solid particles to be manufactured in and any of the shapes can be used in the preferred embodiment of the heat exchanger when their cost can be justified by increased heat transfer. While only eight (8) flat surfaced solids have been disclosed, it is evident that various other many sided solids could be manufactured without departing from the scope of the disclosed heat exchanger. By using small solid particles with shapes that are more likely to make flat contact with a flat surfaced heat exchange surface the amount of heat transferred between fluids can be increased. This allows for the size of a heat exchanger to shrink while continuing to produce the same amount of heat transfer.

Referring again to FIGS. 1 and 2, the heat exchanger is constructed for use with upward flowing fluid that is a gas (such as air) and the sides of the flattened pipe or tubing are sloped from the vertical as shown to encourage the small solid particles to slide down the flat surfaces of the heat exchanger by gravity whenever they are not suspended by the upward flowing fluid. The angle $\theta$ will be from −10° to +10° from vertical for most practical applications. Whenever vertical flat sides are proven to be best for some application, the angle $\theta$ will be 0°. When the highest heat transfer rate is found by experimentation to have the tops of the flattened pipe or tubing to be wider than the bottom, then the angle $\theta$ to be used will be of some minus value. When the upward flowing fluid is a liquid, such as water, the angle $\theta$ will probably be of minus value for most applications to encourage the bubbles to increase in size as they rise to the top, rather than to disappear as the small solid particles tend to move farther apart. The angle $\alpha$ shown in FIG. 2 represents the pitch of the flattened pipe or tubing will be less than 4° from the horizontal for most practical applications. This inclined slope allows for the easy drainage of liquid from the heat exchanger.

There are many applications that are well suited for using heat exchangers that contain and utilize fluidized small solid particles for many different kinds of fluids at different pressures, temperatures, viscosities, densities, etc. Such applications as the heating or cooling of air or water using water, steam, refrigerants, products of combustion, and so forth will be standardized and marketed commercially.

FIG. 1 shows two rows of orifices in the grid plate between two flattened pipes or tubing. For most applications involving air, two rows of orifices should prove to be best. Orifices for air will be spaced far enough apart to discourage the air bubbles from one orifices from merging with the air bubbles from an adjacent orifice. One row of orifices in the grid space between two flattened pipes or tubing will probably prove to serve best when a liquid fluidizes the small solid particles. As many as five rows of orifices in the grid space between two flattened pipes or tubing can be used to prevent small solid particles from draining out. Thus, a bottom woven wire mesh or perforated sheet would not longer be needed when using enough orifices to prevent small particles from draining out.

The cube shown in FIG. 3*a* is expected to be the most common shape for that the small solid particles will be manufactured in. Assume the bed of fluidized small solid particles shown in FIG. 1 is one-half inch deep, it would take about 800,000 cubes of one-thirty second inch side length to fill one square foot of heat exchanger. The surface area of one 1/32" cube is small, but 800,000 such cubes would occupy a total surface area of thirty-two square feet. This is a surface area that moves, rather than being fixed. The small solid particles will move from the surface of the flattened pipe or tubing, out into the boiling fluidized bed and back again, many times each second. The heat transfer rate will be greatly enhanced.

The pressure drop across the bed of small solid particles must equal the weight per unit area of the bed for the bed to be fluidized. This pressure drop requirement generally limits the depth of the bed of small solid particles to one and one-half inches or less for most heat exchangers that use solid metal particles, like aluminum. For heat exchangers constructed according to the principles of this invention to be built using bed depths above one and one-half inches will probably necessitate using some metal coated light weight material for the small solid particles to be commercially competitive. It is not necessary, however, for heat exchangers having a bed depth above one and one-half inches to use some metal coated light weight material for the small solid particles to be commercially competitive.

It is not necessary for the flattened pipe or tubing to be of separate construction from the grid plate as shown on FIGS.

1 and 2. The horizontal passages with flat surfaces could be made in one piece with the grid plate. The grid plate could be constructed having a greater thickness to accommodate orifices other than the rounded entrance type orifices shown in FIGS. 1 and 2.

What is claimed is:

1. A heat exchanger, comprising:

a plurality of spaced-apart passages positioned in an array within a bed of said heat exchanger while confining and separately conveying a first fluid through said heat exchanger, neighboring pairs of said spaced-apart passages dividing said bed into intermediate volumes, each of said passages having a plurality of flat surfaces and any one of either a rectangular cross-section, a trapezoidal cross-section, or a triangular cross-section;

a grid plate attached on a bottom side of said heat exchanger and perforated by a plurality of orifices conveying a second fluid through said volumes formed between neighboring pairs of said spaced-apart passages, to fluidize a plurality of solid particles disposed within said volumes;

any one of either a perforated sheet or a woven wire mesh being attached to a top side of said passages to prevent said solid particles from exiting said heat exchanger;

any one of a second woven wire mesh or a second perforated sheet being attached to an inlet side of said grid plate to prevent particles from draining out of said heat exchanger through said orifices; and said particles having a second plurality of fat surfaces forming any one of either a cubic shape, a prism shape with rectangular ends, a prism shape with triangular ends, a prism shape with square ends, a prism shape with more than four sides, or a prism shape with ends of any geometric shape that can be made using straight lines, said second plurality of flat surfaces of said solid particles contactable with said first plurality of flat surfaces of said passages to transfer heat between said first fluid and said second fluid.

2. The heat exchanger of claim 1, further comprising said first plurality of flat surfaces of said passages being inclined between −34° and +34° from a plane perpendicular to the plane of a base of said heat exchanger.

3. The heat exchanger of claim 1, further comprising a vertical divider positioned at intervals between said passages to prevent said solid particles from draining to a lower side of said heat exchanger when said heat exchanger is pitched.

4. The heat exchanger of claim 1, wherein said passages are integrally constructed with said grid plate.

5. The heat exchanger of claim 1, further comprised of said passages having a lower portion pitched into said grid plate.

6. The heat exchanger of claim 1, further comprised of said solid particles being constructed of a solid phase of any one of aluminum, copper, silver and any comparable high heat conduction material.

7. The heat exchanger of claim 1, further comprised of said solid particles having a surface layer constructed of any one of aluminum, copper, silver and any comparable high heat conduction material.

8. The heat exchanger of claim 1, further comprised of said solid particles having a longest dimension being from approximately 0.005 inches to 0.2 inches.

9. The heat exchanger of claim 1, further comprised of said solid particles having an end angled between approximately 0° to 60° from a lengthwise centerline.

10. The heat exchanger of claim 1, farther comprised of said solid particles being of different shapes.

11. The heat exchanger of claim 1, further comprised of said passages passing through said heat exchanger along any one of either an axis parallel to a base of said heat exchanger or a pitched angle being in the range of 0 to 80 degrees from said axis.

12. The heat exchanger of claim 1, further comprising a vertical divider positioned at intervals between said passages to increase heat transfer.

13. A heat exchanger, comprising:

a plurality of spaced-apart passages positioned in an array conveying a first fluid through said heat exchanger, said passages each having a first plurality of flat surfaces and any one of either a rectangular cross-section, a trapezoidal cross-section, or a triangular cross-section;

a plurality of orifices conveying a second fluid through said heat exchanger to fluidize a plurality of solid particles disposed between said spaced-apart passages;

any one of either a perforated sheet or a woven wire mesh being attached to a top side of said passages to prevent said solid particles from exiting said heat exchanger;

any one of a second woven wire mesh or a second perforated sheet being attached to an inlet side of said orifices to prevent particles from draining out of said heat exchanger through said orifices; and said solid particles having a second plurality of flat surfaces contactable with said first plurality of flat surfaces of said passages to transfer heat between said first fluid and said second fluid.

14. The heat exchanger of claim 13, further comprising said passages having a plurality of flat side surfaces that are inclined between −34° and +34° from a plane perpendicular to the plane of a base of said heat exchanger.

15. The heat exchanger of claim 13, further comprising a vertical divider positioned at intervals between said passages to prevent said solid particles from draining to a lower side of said heat exchanger when said heat exchanger is pitched.

16. The heat exchanger of claim 13, wherein said passages is integrally constructed with said grid plate.

17. The heat exchanger of claim 13, further comprised of said passages having a lower portion pitched into said grid plate.

18. The heat exchanger of claim 13, further comprised of said solid particles being constructed of any one of aluminum, copper, silver and any comparable high heat conduction material.

19. The heat exchanger of claim 13, further comprised of said solid particles having a surface layer constructed of any one of aluminum, copper, silver and any comparable high heat conduction material.

20. The heat exchanger of claim 13, further comprised of said solid particles having a length dimension in a range from 0.005 inches to 0.2 inches.

21. The heat exchanger of claim 20, further comprised of said solid particles having any one of either a cube shape, a prism shape with rectangular ends, a prism shape with triangular ends, a prism shape with square ends, a prism shape with more than four sides, and a prism shape with ends of any geometric shape that can be made using straight lines.

22. The heat exchanger of claim 21, further comprised of said solid particles having an end angled between 0° to 60° from a lengthwise centerline.

23. The heat exchanger of claim 22, further comprised of said solid particles being a mixture of shapes.

24. The heat exchanger of claim 23, further comprising said passages passing through said heat exchanger any one of either along an axis parallel to a base of said heat exchanger and along a pitched angle ranging from 0° to 80° from said axis.

25. The heat exchanger of claim 13, further comprising a vertical divider positioned at intervals between said passages to increase heat transfer.

26. A heat exchanger, comprising:

at least one passage conveying a first fluid through said heat exchanger, said at least one passage having a first plurality of flat surfaces;

a plurality of orifices conveying a second fluid through said heat exchanger to fluidize a plurality of solid particles;

any one of either a perforated sheet or a woven wire mesh being attached to a top side of said at least one passage to prevent said solid particles from exiting said heat exchanger;

any one of a second woven wire mesh or a second perforated sheet being, attached to an inlet side of said orifices to prevent particles from draining out of said heat exchanger through said orifices; and said solid particles having a length between 0.005 inches to 0.2 inches and having a second plurality of flat surfaces forming any one of either a cube shape, a prism shape with rectangular ends, a prism shape with triangular ends, a prism shape with square ends, a prism shape with more than four sides, or a prism shape with ends of any geometric shape that can be made using, straight lines, said second plurality of flat surfaces of said solid particles contactable with said first plurality of flat surfaces of said at least one passage to transfer heat between said first fluid and said second fluid.

27. The heat exchanger of claim 26, further comprised of said solid particles being constructed of any one of aluminum, copper, silver and any comparable high heat conduction material.

28. The heat exchanger of claim 26, further comprised of said solid particles having a surface layer constructed of any one of aluminum, copper, silver and any comparable high heat conduction material.

29. The heat exchanger of claim 26, further comprised of said sold particles having an end angled between 0 to 60 from a lengthwise centerline.

30. The heat exchanger of claim 26, further comprised of said at least one passage having said flat surfaces that form a predetermined angle between an outer surface of said flat surfaces and a base of said heat exchanger, said predetermined angle being in the range of between approximately 56 degrees to approximately 124 degrees.

31. The heat exchanger of claim 26, further comprised of said at least one passage passing through said heat exchanger along any one of either an axis parallel to a base of said heat exchanger or a pitched angle ranging from 0 to 80 degrees from said axis.

32. A heat exchanger, comprising:

at least one passage conveying a first fluid through said heat exchanger and having a top side, two sidewalls, and a bottom side said sidewall having a first flat surface;

a plurality of orifices conveying a second fluid through said heat exchanger to fluidize a plurality of solid particles disposed between said passages;

any one of either a perforated sheet or a woven wire mesh being attached to said top side of said passage to prevent said solid particles from exiting said heat exchanger;

any one of either a second perforated sheet or a second woven wire mesh being attached to said orifices to prevent said solid particles from draining out of said heat exchanger through said orifices; and at least one divider located between said sidewalls of said two passages, dividing said solid articles.

33. The heat exchanger of claim 32, further comprised of said divider located between said sidewall and said heat exchanger.

34. The heat exchanger of claim 32, further comprised of said divider attached to said sidewall of said passage.

35. The heat exchanger of claim 32, further comprised of said divider being attached to said any one of either said perforated sheet or said woven wire mesh.

36. The heat exchanger of claim 32, further comprised of said passage having any one of either a rectangular cross-section, a trapezoidal cross-section or a triangular cross-section.

37. The heat exchanger of claim 32, further comprised of said sidewall having flat surfaces that forms a predetermined angle between said flat surface of said sidewall and a base of said heat exchanger.

38. The heat exchanger of claim 32, further comprised of a plane of said bottom side of said passage being inclined from the plane of a base of said heat exchanger.

39. The heat exchanger of claim 32, further comprised of a plane of said orifices being inclined from the plane of a base of said heat exchanger.

40. The heat exchanger of claim 32, further comprised of said solid particles having a second plurality of flat surfaces forming any one of either a cubic shape, a prism shape with rectangular ends, a prism shape with triangular ends, a prism shape with square ends, a prism shape with more than four sides, or a prism shape with ends of any geometric shape that can be made using straight lines, said second plurality of flat surfaces of said solid particles contactable with said first flat surface of said sidewall of said passage to transfer heat between said first fluid and said second fluid.

41. A heat exchanger, comprising:

a plurality of spaced-apart passages positioned in an array conveying a first fluid through said heat exchanger, said passages each having a fist plurality of surfaces and any one of either a rectangular cross-section, a trapezoidal cross-section, or a triangular cross-section;

a plurality of orifices conveying a second fluid through said heat exchanger to fluidize a plurality of solid particles disposed between said spaced-apart passages;

any one of either a perforated sheet or a woven we mesh being attached to a top side of said passages to prevent said solid particles from exiting said heat exchanger;

any one of a second woven wire mesh or a second perforated sheet being attached to an inlet side of said orifices to prevent particles from draining out of said heat exchanger through said orifices; and said solid particles having a second plurality of surfaces contactable with said first plurality of surfaces of sad passages to transfer heat between said first fluid and said second fluid.

* * * * *

UNITED STATES PATENT AND TRADEMARK OFFICE

CERTIFICATE OF CORRECTION

PATENT NO. : 6,263,958 B1
DATED : July 24, 2001
INVENTOR(S) : Fleischman

It is certified that error appears in the above-identified patent and that said Letters Patent is hereby corrected as shown below:

Title page,
The title page should be deleted to appear as per attached title page.

Item [12 and 76] should read -- Fleischman --.

Signed and Sealed this

Fifth Day of February, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,263,958 B1
DATED : July 24, 2001
INVENTOR(S) : Fleischman

It is certified that error appears in the above-identified patent and that said Letters Patent is hereby corrected as shown below:

(12) United States Patent
Fleischman

(10) Patent No.: US 6,263,958 B1
(45) Date of Patent: *Jul. 24, 2001

(54) HEAT EXCHANGERS THAT CONTAIN AND UTILIZE FLUIDIZED SMALL SOLID PARTICLES

(76) Inventor: William H. Fleischman, 836 Rio Dr., Friendsville, TN (US) 37737

(*) Notice: This patent issued on a continued prosecution application filed under 37 CFR 1.53(d), and is subject to the twenty year patent term provisions of 35 U.S.C 154(a)(2).

Subject to any disclaimer, the term of this patent is extended or adjusted under 35 U.S.C. 154(b) by 6 days.

(21) Appl. No.: 09/028,053

(22) Filed: Feb. 23, 1998

(51) Int. Cl.[7] ..... F28D 13/00

(52) U.S. Cl. ..... 165/104.16; 165/104.15; 122/4 D; 422/146; 422/147

(58) Field of Search ..... 165/104.15, 104.16; 422/146, 147; 122/4 D

(56) References Cited

U.S. PATENT DOCUMENTS

| | | | | |
|---|---|---|---|---|
| 2,934,551 | * | 4/1960 | Stringer | 165/104.16 |
| 3,053,704 | * | 11/1962 | Munday | 165/104.16 |
| 3,645,237 | * | 2/1972 | Seth | 165/104.16 |
| 3,645,700 | | 2/1972 | Nagamura et al. . | |
| 3,666,006 | | 5/1972 | Valyi . | |
| 3,794,110 | | 2/1974 | Severijnns . | |
| 3,814,176 | * | 6/1974 | Seth | 165/104.16 |
| 3,864,282 | | 2/1975 | Young . | |
| 3,897,546 | | 7/1975 | Beranek et al . | |
| 3,902,550 | | 9/1975 | Martin et al. . | |
| 3,930,800 | * | 1/1976 | Schoener et al. | 165/104.16 |
| 3,990,862 | | 11/1976 | Dahl et al. . | |
| 4,025,462 | | 5/1977 | Cleveland . | |
| 4,096,214 | | 6/1978 | Percevault et al. . | |
| 4,111,675 | | 9/1978 | Ballard . | |
| 4,119,139 | | 10/1978 | Klaren . | |
| 4,149,586 | * | 4/1979 | Phillips et al. | 165/104.16 |
| 4,335,785 | * | 6/1982 | Hodges et al. | 165/104.16 |
| 4,423,558 | | 1/1984 | Meunier . | |
| 4,450,895 | | 5/1984 | Meunier et al. . | |
| 4,472,358 | | 9/1984 | Khudenko . | |
| 4,478,276 | | 10/1984 | Rosenbaum et al . | |
| 4,499,944 | * | 2/1985 | Komakine | 165/104.16 |
| 4,522,252 | | 6/1985 | Klaren . | |
| 4,526,759 | * | 7/1985 | Stewart | 165/104.16 |
| 4,561,385 | | 12/1985 | Cross et al. . | |
| 4,580,618 | | 4/1986 | Newby . | |
| 4,588,429 | | 5/1986 | Hohman et al . | |
| 4,597,362 | * | 7/1986 | Daudet et al. | 165/104.16 |
| 4,674,560 | | 6/1987 | Marcellin . | |
| 4,719,968 | | 1/1988 | Speros . | |
| 4,796,691 | | 1/1989 | Large et al. . | |
| 4,823,739 | | 4/1989 | Marcellin . | |
| 4,862,954 | | 9/1989 | Hellio et al. . | |
| 4,955,942 | * | 9/1990 | Hemenway, Jr. | 165/104.16 |
| 4,971,141 | | 11/1990 | Kasahara et al. . | |
| 4,981,355 | | 1/1991 | Higgins . | |
| 5,000,255 | | 3/1991 | Pflum . | |
| 5,109,918 | | 5/1992 | Huschka et al. | |

(List continued on next page.)

OTHER PUBLICATIONS

"Adapt Fluidized Bed Coal Firing to Process Heaters" D.C. Cherrington and L.P Golan in Hydrocarbon Processing May 1978.

*Primary Examiner*—Ira S. Lazarus
*Assistant Examiner*—Terrell McKinnon
(74) *Attorney, Agent, or Firm*—Robert E. Bushnell, Esq.

(57) ABSTRACT

Heat exchangers that utilize flat surfaced passages to contact, contain and utilize fluidized small solid particles. A variety of flat surfaced small solid particles with high heat transfer surfaces are provided to further enhance the heat transfer rate. Astonishingly high heat transfer coefficients have been reported for surfaces immersed in fluidized beds. More energy efficient systems of all kinds will result from the use of these smaller heat exchangers.

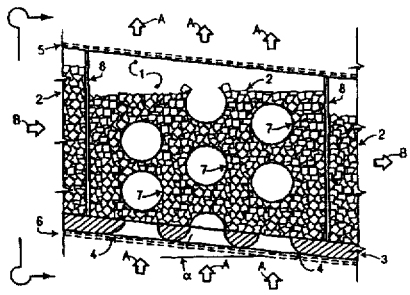

41 Claims, 2 Drawing Sheets